US007540773B2

(12) United States Patent
Ko

(10) Patent No.: US 7,540,773 B2
(45) Date of Patent: Jun. 2, 2009

(54) CONNECTOR ASSEMBLY WITH IMPROVED STRAIN RELIEF STRUCTURE

(75) Inventor: David (Tso-Chin) Ko, Fullerton, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 172 days.

(21) Appl. No.: 11/811,042

(22) Filed: Jun. 8, 2007

(65) Prior Publication Data

US 2008/0305658 A1 Dec. 11, 2008

(51) Int. Cl.
*H01R 9/05* (2006.01)

(52) U.S. Cl. ..... 439/581; 439/610

(58) Field of Classification Search ..... 439/581, 439/582, 610, 76.1, 470, 468
See application file for complete search history.

(56) References Cited

U.S. PATENT DOCUMENTS

| | | | | |
|---|---|---|---|---|
| 4,406,512 | A * | 9/1983 | Schell | 439/497 |
| 4,453,798 | A * | 6/1984 | Asick et al. | 439/581 |
| 6,663,415 | B1 | 12/2003 | Wu | |
| 6,706,970 | B2 | 3/2004 | Laub et al. | |
| 6,971,913 | B1 * | 12/2005 | Chu | 439/582 |
| 7,186,144 | B1 * | 3/2007 | Khemakhem et al. | 439/620.03 |
| 7,204,695 | B1 | 4/2007 | Shiu et al. | |
| 2007/0072443 | A1 | 5/2007 | Rohrbach et al. | |
| 2008/0003881 | A1 * | 1/2008 | Wu | 439/610 |
| 2008/0318476 | A1 * | 12/2008 | Weber et al. | 439/610 |
| 2009/0004917 | A1 * | 1/2009 | Ice | 439/610 |

FOREIGN PATENT DOCUMENTS

| | | |
|---|---|---|
| TW | M260910 | 4/2005 |
| TW | M266589 | 6/2005 |

* cited by examiner

*Primary Examiner*—Hien Vu
(74) *Attorney, Agent, or Firm*—Wei Te Chung

(57) ABSTRACT

A connector assembly (100) includes a housing (2) defining a number of passageways (23, 24) along a mating direction, a number of conductive contacts (3) interferentially received in the passageways of the housing, a circuit board (4) electrically connecting with the conductive contacts and comprising opposite front and rear surfaces and opposite top and bottom edges connecting with the front and rear surfaces, a cable (9) electrically connecting with the circuit board, and comprising an inner conductor (91) a metal braiding layer (92) and an outer jacket enclosing the metal braiding layer, and a strain relief member (5) including a strain relief section (52) grasping the cable and at least one connecting portion (510) electrically connecting with the circuit board. The connecting portion of the strain relief member contacts the opposite front and rear surfaces and locates adjacent to one of the opposite top and bottom edges of the circuit board at the same time.

15 Claims, 9 Drawing Sheets

CONNECTOR ASSEMBLY WITH IMPROVED STRAIN RELIEF STRUCTURE

BACKGROUND OF THE INVENTION

1. Field of the Invention

The present invention generally relates to a connector assembly, and more particularly to a connector assembly used for power transmission.

2. Description of Related Art

Metal strain relief member is widely used in a cable connector assembly for providing mechanical support and grounding function to a cable. Usually, there are two types of strain relief member currently. One type is that a conductive shell forms a train relief section grasping a metal braiding layer of a cable to provide mechanical support and grounding function. The other type is that a cable connector assembly has a separate strain relief member comprising a strain relief section grasping a metal braiding layer of the cable and electrically connects with a metal shell of the cable connector assembly to realize mechanical support and grounding function, such as disclosed in U.S. Pat. Nos. 6,706,970B2, 6,663,415B1. However, none of the patents mentioned above discloses that when a cable connector assembly has a printed circuit board and has no conductive shell, how to arrange a strain relief member in such cable connector assembly and how to realize the mechanical support and grounding function to a cable? Thus, it is desired to design a new structure to address the problems above.

BRIEF SUMMARY OF THE INVENTION

Accordingly, an object of the present invention is to provide a connector assembly with improved strain relief structure for achieving reliable mechanical support to the connector assembly.

In order to achieve the above-mentioned object, a connector assembly in accordance with the present invention comprises a housing defining a plurality of passageways along a mating direction, a plurality of conductive contacts interferentially received in the passageways of the housing, a circuit board electrically connecting with the conductive contacts and comprising opposite front and rear surfaces and opposite top and bottom edges connecting with the front and rear surfaces, a cable electrically connecting with the circuit board, and comprising an inner conductor, a metal braiding layer and an outer jacket enclosing the metal braiding layer, and a strain relief member comprising a strain relief section grasping the metal braiding layer of the cable and at least one connecting portion electrically connecting with the circuit board, the connecting portion of the strain relief member contacts the opposite front and rear surfaces and locates adjacent to one of the opposite top and bottom edges of the circuit board at the same time.

Other objects, advantages and novel features of the invention will become more apparent from the following detailed description of the present embodiment when taken in conjunction with the accompanying drawings.

DETAILED DESCRIPTION OF THE INVENTION

Figure 1:
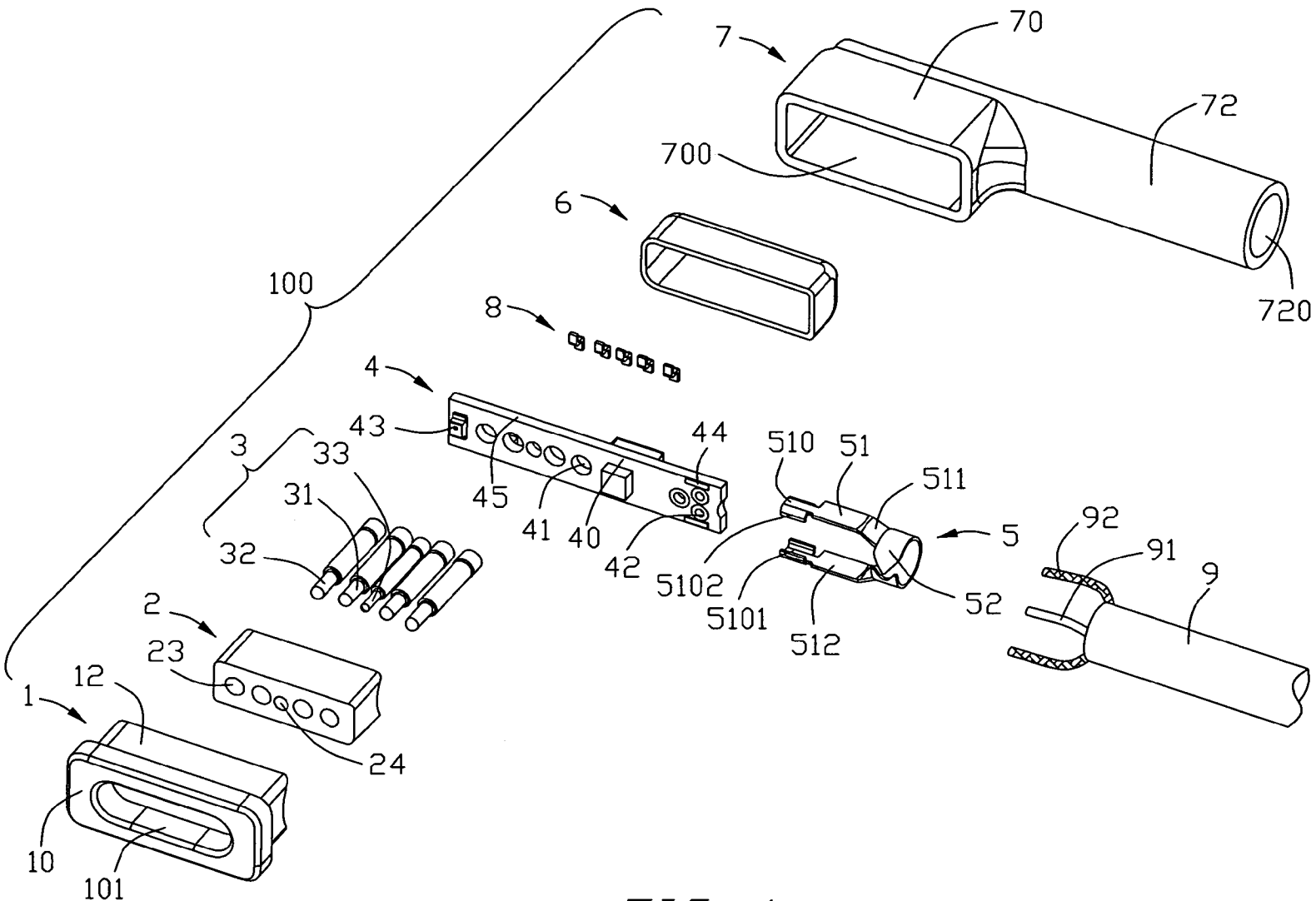
FIG. 1 is an exploded, perspective view of a connector assembly in accordance with the first embodiment of the present invention.

Reference will now be made to the drawing figures to describe the present invention in detail.

Figure 2:
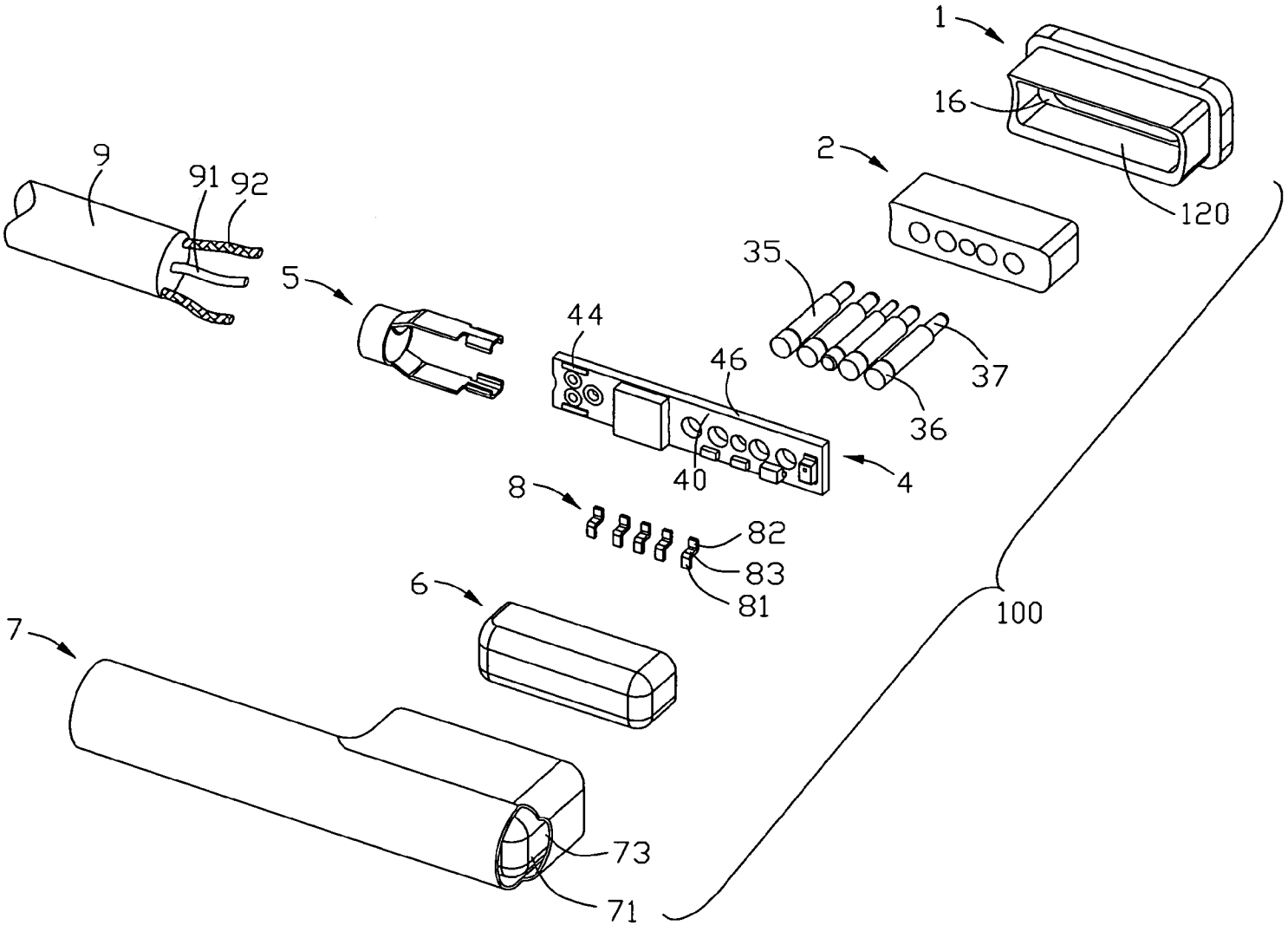
FIG. 2 is a view similar to FIG. 1, but viewed from a different aspect.
Figure 3:
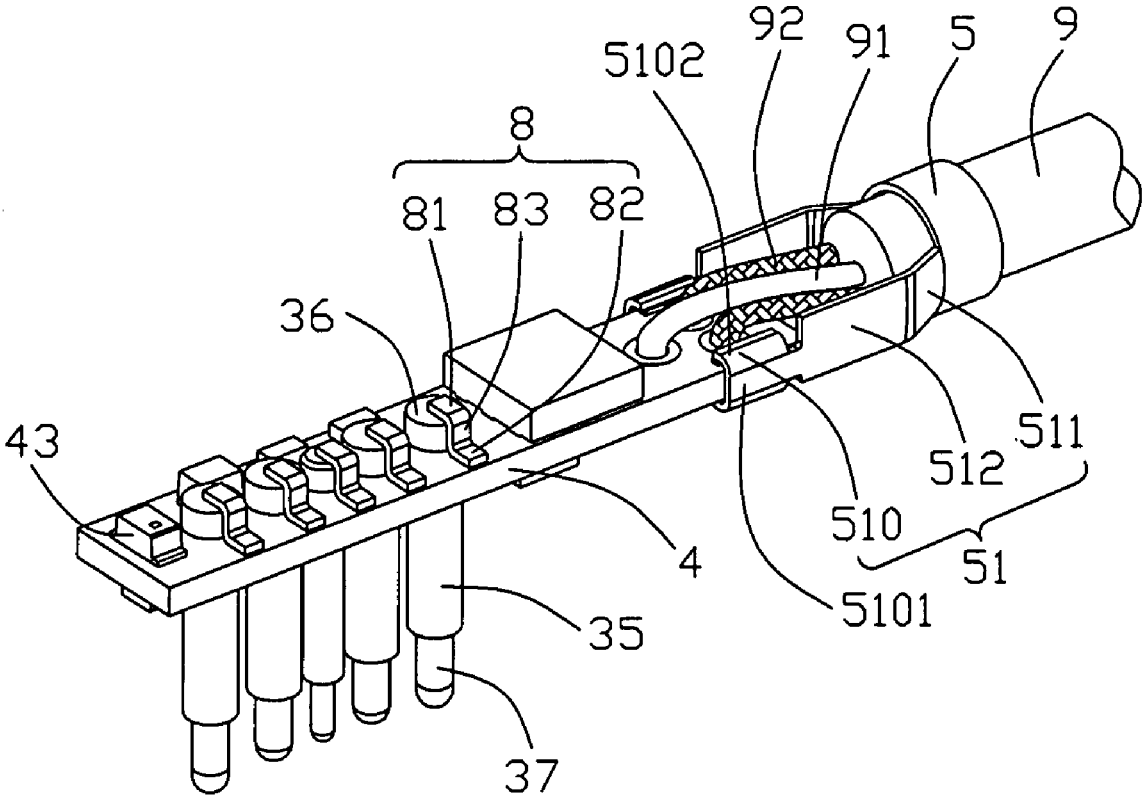
FIGS. 3-6 are partially assembled views of the connector assembly of the connector assembly in accordance with the first embodiment.

Referring to FIGS. 1-3, a connector assembly 100 in accordance with the first embodiment of the present invention comprises an insulative housing 2, a plurality of conductive contacts 3 assembled to the housing 2, a circuit board 4 assembled to the housing 2, a plurality of solder tails 8 respectively electrically connecting with the contacts 3 and the circuit board 4, a strain relief member 5 assembled to and electrically connecting with the circuit board 4, a cable 9 mechanically connecting with the strain relief member 5 and electrically connecting with the circuit board 4 to achieve the electrical connection with the conductive contacts 3, front and rear covers 1, 7 respectively assembled to the housing 2 and together enclosing the elements mentioned above therebetween.

Now turning to FIGS. 1-2, the housing 2 is made from insulative material. The housing 2 defines two pairs of large-size first receiving passages 23 and a center small-size second receiving passage 24 respectively recessed from a front face thereof to a rear face thereof. Particularly, the right side surface is curved for forming a whole toothbrush design of the connector assembly 100.

Now referring to FIGS. 1-2, the conductive contacts 3 consist of a pair of ground contacts 32, a pair of power contacts 31 located between the pair of ground contacts 32 and a center detect contact 33 located between the pair of power contacts 31. Each contact 3 is of a POGO Pin type, that is to say, there is a spring (not shown) inside the contact 3, thus, when mating, front contacting portion 37 of the contact 3 can be pressed to rearward move along the mating direction. Each ground contact 32 comprises the column-shape contacting portion 37 with a relatively small diameter and capable of being compressed, a column-shape media portion 35 with a relatively large diameter, and an end portion 36 formed at rear end of the media portion 35 with a column-shape and larger diameter. The power contact 31 has the same structure as that of the ground contact 32 except the contacting portion 37 thereof has a length shorter than that of the ground contact 32. Thus, the ground contacts 32 will firstly mate with the complementary connector and lastly disengage from the complementary connector for assuring safe power and signal transmission. The detect contact 33 has the same structure as that of the power contact 31 except each portion thereof has a smaller diameter than that of the power contact 31.

Figure 4:
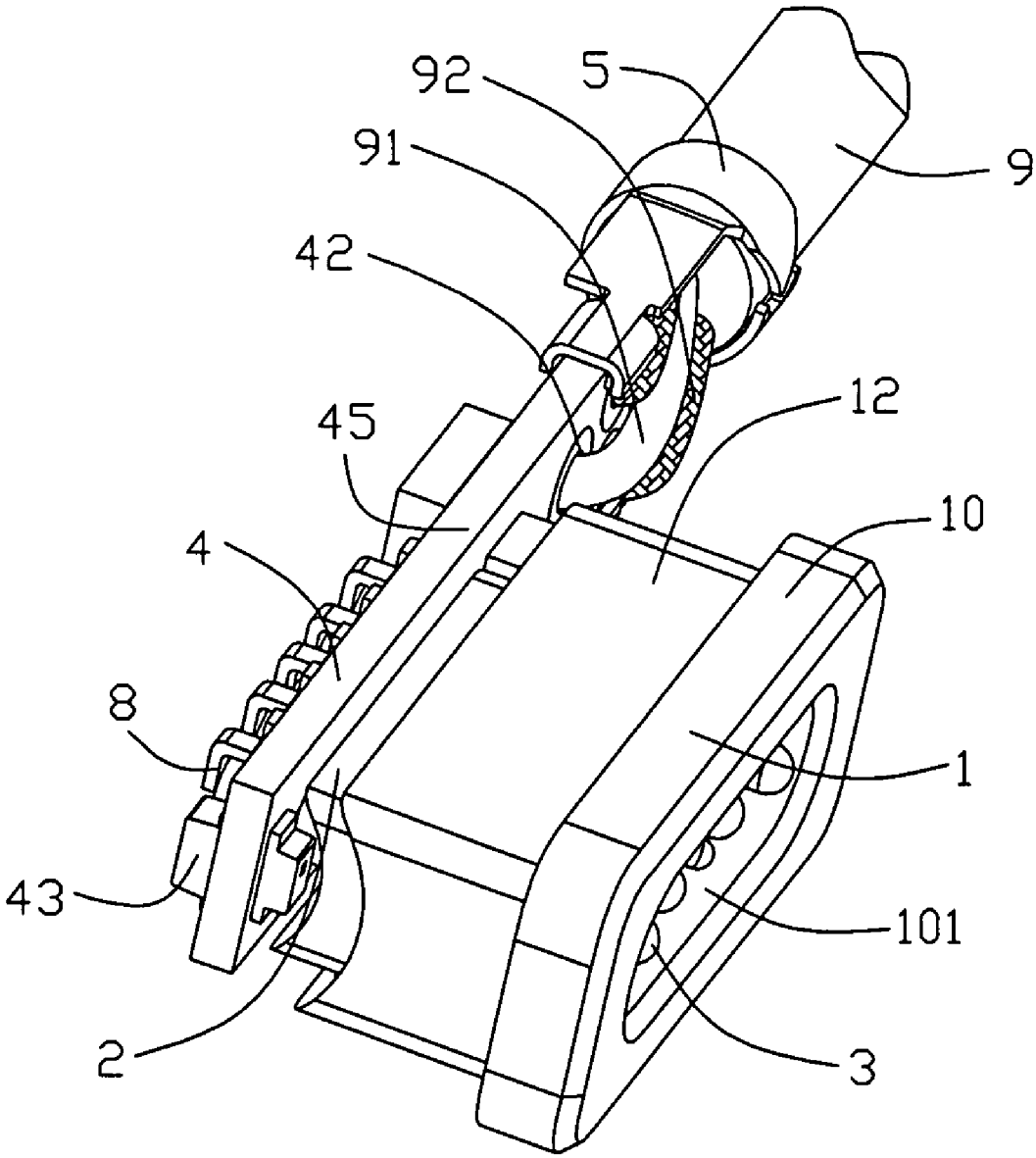
Figure 5:
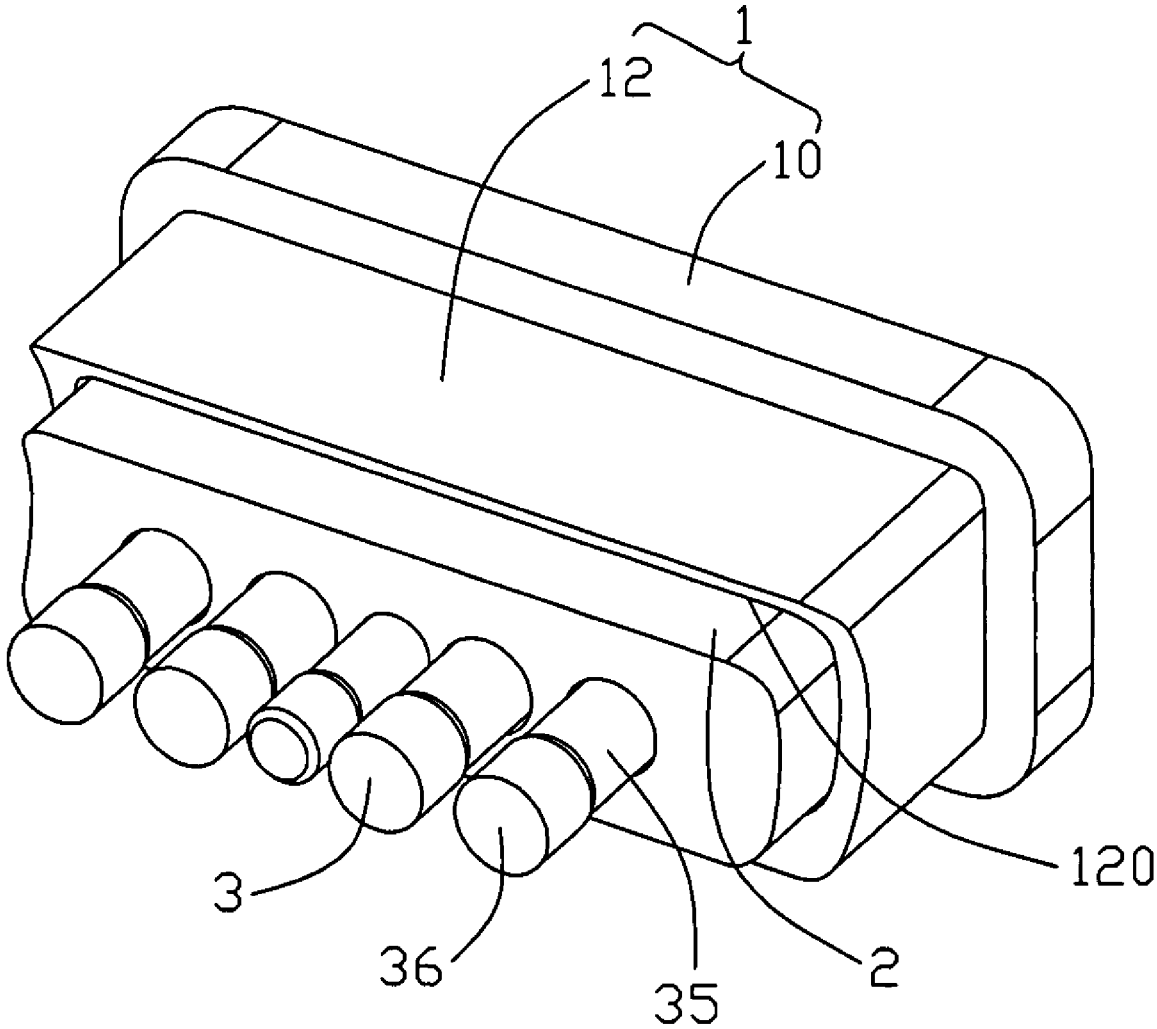
Figure 6:
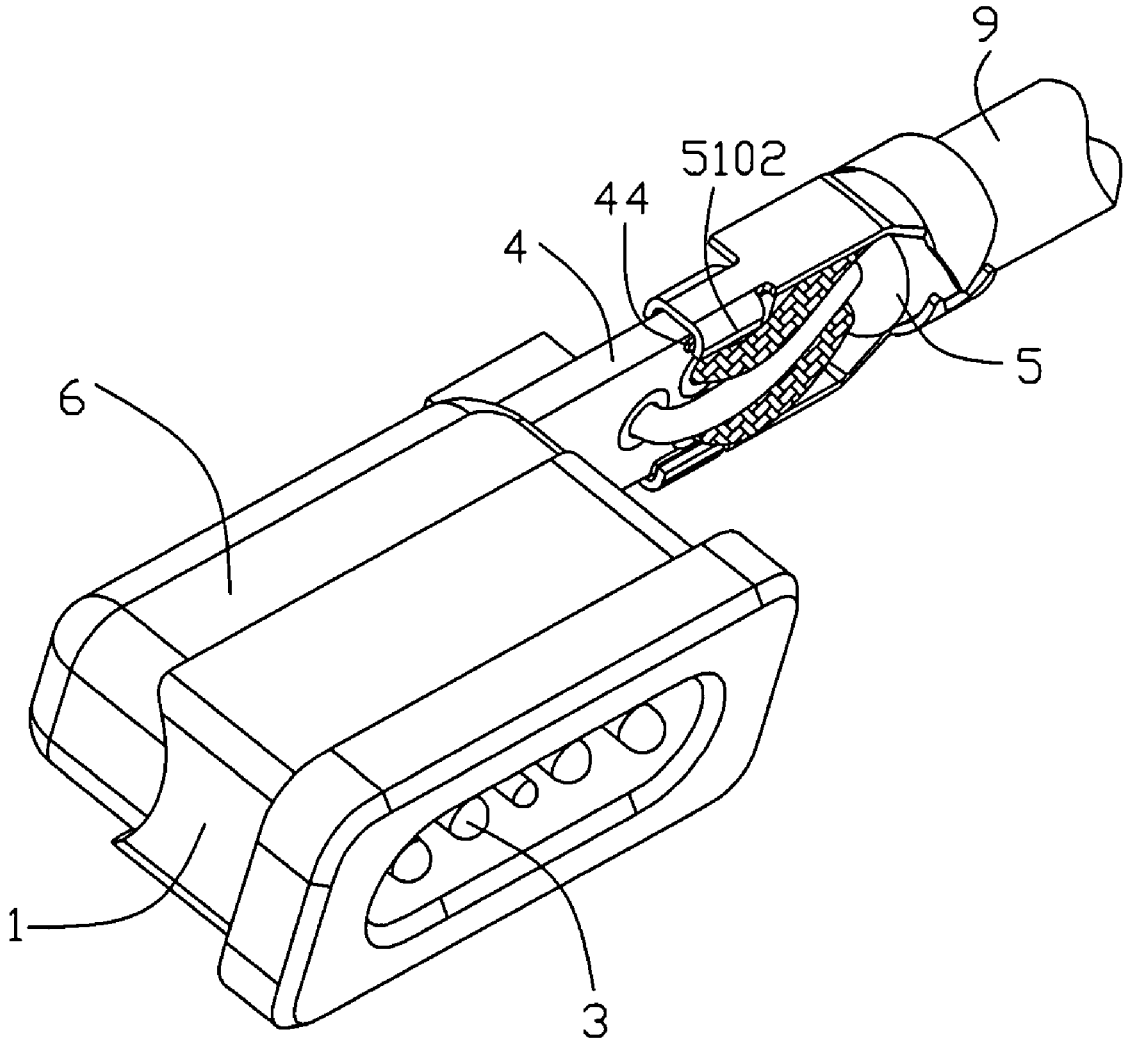
Figure 7:
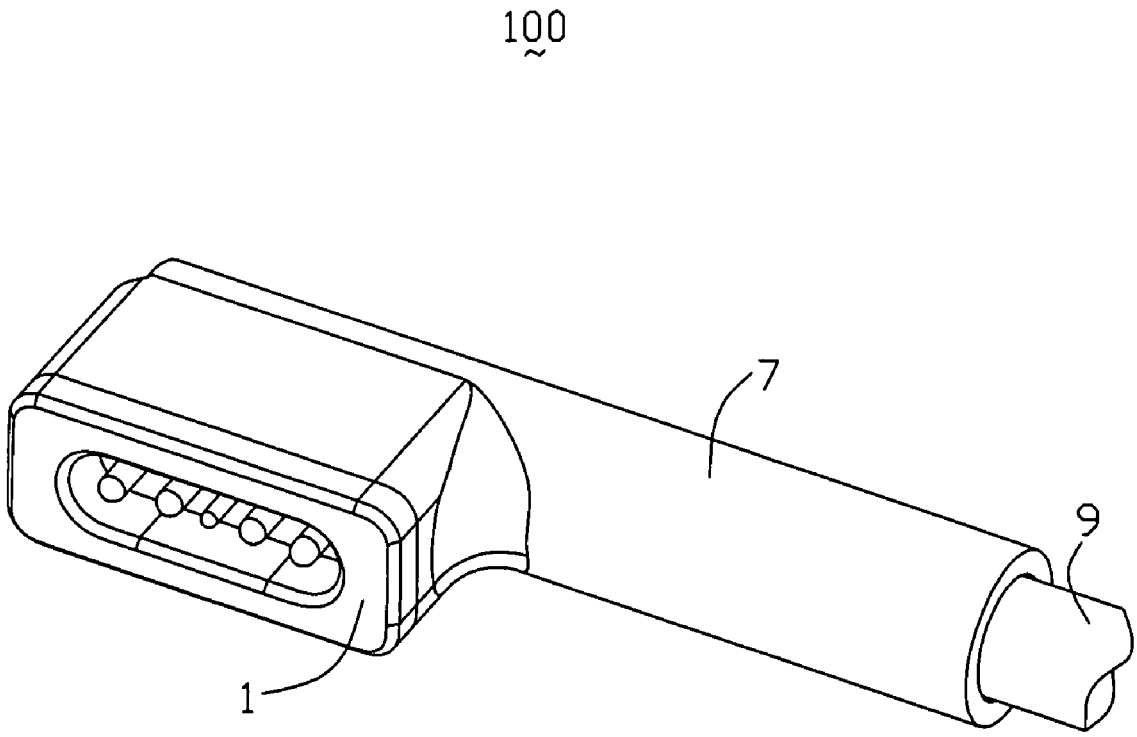
FIGS. 7-8 are assembled, perspective views of the connector assembly in accordance with the first embodiment of the present invention, but viewed from different aspects.
Figure 8:
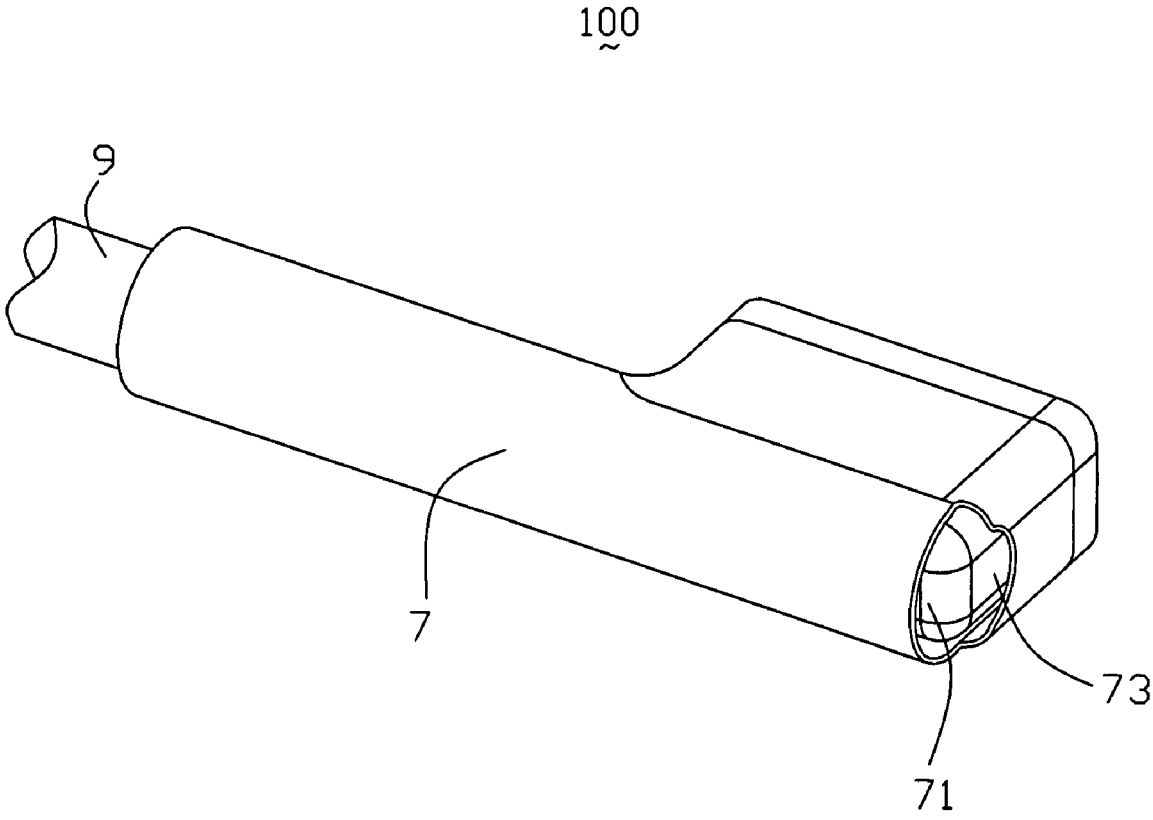

Referring to FIGS. 1-2 and 4, the solder tails 8, or the solder tails, consist of five pieces and each is Z-shape. Each solder tail 8 comprises a first connecting section 81, a second connecting section 82 parallel to the first connecting section 81, and a horizontal media section 83 interconnecting the first and second connecting sections 81, 82.

Referring to FIGS. 1-2, the circuit board 4 is mainly located in a vertical plane and has a certain thickness along a front-to-back direction, that is, the mating direction. The circuit board 4 comprises a substrate 40 having a front surface and an opposite rear surface, also having a top edge 45, a bottom edge 46, a left end and a right end extending between the top and bottom edges 45, 46. A plurality of passageways 41 penetrating from the front surface to the rear surface of the substrate 40 with diameters corresponding to those of the media portions 35 of the contacts 3. The passageways 41 are arranged in one line along transverse direction perpendicular to the mating direction. Three through holes 42 are defined in the substrate 40 and around the right end of the substrate 40 and arranged in triangular shape. Each through hole 42 is plated with conductive material for electrically connecting with the cable 9. In addition, each of the front and rear surfaces forms a pair of pads 44 around the right end and respectively located adjacent to the top and bottom edges 45, 46. Therefore, each pair of pads 44 on the same surface are located above and below corresponding through holes 42 which aligned in vertical direction. A pair of LEDs (Light Emitting Diode) 43 is formed on the front surface and the rear surface and located adjacent to the left end of the substrate 40. The circuit board 4 may be equipped with an IC 44 for driving the LEDs 43 to emit light. Thus, the circuit board 4 has a left area on which the LEDs 43 and the passageways 41 are arranged and a right area on which the pads 44 and the through holes 42 are arranged.

The strain relief member 5 is stamped from metal material or other conductive material. The strain relief member 5 comprises a strain relief section 52 for grasping outer jacket of the cable 9, a pair of arms 51 extending horizontally from upper and lower locations of the strain relief section 52 and parallel to each other, and a pair of connecting portions 510 formed at distal ends of the pair of arms 51. Each arm 51 is located in the horizontal plane and comprises an inclined section 511 connecting with the strain relief section 52, and a flat section 512 connecting with the connecting portion 510. The connecting portion 510 is of U-shape and comprises a flat connecting section 5101 and a pair of arc-shape side sections 5102 substantially vertically extending from the connecting section 5101 to form the U-shape for electrically connecting with the pads 44 of the circuit board 4.

The cable 9 comprises an inner conductor 91, a metal braiding layer 92 surrounding the inner conductor 91, and an outer jacket enclosing the metal braiding layer 92. A front portion of the outer jacket is stripped to expose part of the inner conductor 91 and the metal braiding layer 92. Further, the exposed metal braiding layer 92 of the cable 9 is formed into two parts served as a negative pole of the connector assembly 100, of course, the inner conductor 91 is served as a positive pole of he connector assembly 100.

The front and rear covers 1, 7 are respectively assembled to the housing 2. The front cover 1 is made from conductive material and capable of being attracted by the complementary connector. The front cover 1 comprises a body portion 12 and a front rectangular flange 10 with certain thickness and formed with front edge of the body portion 12. The flange 10 defines an elliptical-shape front receiving cavity 101 recessed rearwardly from a front surface thereof for receiving complementary connector. The body portion 12 defines a rectangular rear receiving passage 120 recessed forwardly from a rear surface thereof to communicate with the front receiving cavity 101 for receiving the housing 2. The receiving passage 120 has a large size along a lateral direction of the front cover 1 than that of the receiving cavity 101, thus, forming a step surface 16.

The rear cover 7 is made from resin material and of toothbrush shape. The rear cover 7 comprises a substantially rectangular main body 70 and a pipe-shape existing portion 72 extending vertically from the main body 70. The main body 70 defines a receiving space 700 recessed rearwardly from front surface thereof, while, the existing portion 72 defines a circular existing channel 720 communicating with the receiving space 700 for existing the cable therefrom. Particularly, the rear cover 7 defines a window area 73 with irregular shape. A light pipe 71 is firstly molded and shaped corresponding to the configuration of the left end of the circuit board 4 and the pair of LEDs 43, then the rear cover 7 is molded over the light pipe 71 to expose the light pipe 71 in the window area 73. Thus, the rear cover 7 and the light pipe 71 are formed as a unitary one. The light emitted from the pair of LEDs 43 spreads from the inner mold 6 to the light pipe 71, and finally can be seen from outside.

The inner mold 6 is made from transparent or semitransparent material and the light emitted from the LEDs 43 is capable of being spread out through the inner mold 6 to outside.

Referring to FIGS. 3-8 in conjunction with FIGS. 1-2, in assembly, the conductive contacts 3 firstly pass through the passageways 41 of the circuit board 4 from rear-to-front direction until the end portions 36 abutting against the rear surface of the circuit board 4. Each Z-shape solder tail 8 is respectively soldered with corresponding contact 3 and trace formed on the rear surface of the circuit board 4. The first and second connecting sections 81, 82 are respectively soldered to the end portion 36 and the trace of the circuit board 4, while, the media section 83 attaches to side surface of the end portion 36. The contacts 3 then are assembled to the insulative housing 2 with the media portions 35 interferentially received in the first and second receiving passages 23, 24 of the housing 2, while, the contacting portions 37 exposed beyond the front surface of the insulative housing 2. The housing 2 with the contacts 3 and the circuit board 4 is assembled to the front cover 1 with the housing 2 received in the receiving passage 120 of the body portion 12 and the contacting portions 37 of the contacts 3 are exposed in the receiving cavity 101.

Then the inner mold 6 is molded to the connection area between the contacts 3 and the circuit board 4, the solder tails 8, and rear portion of the insulative housing 2 with the right end of the circuit board 4 exposed beyond the inner mold 6. Since the material of the inner mold 6 is transparent or semitransparent, the light emitted from the LEDs 43 of the circuit board 4 can be spread out from the left corner of the inner mold 6. The inner conductor 91 and the two parts of the metal braiding layer 92 of the cable 9 are respectively inserted into and soldered to the through holes 42 of the circuit board 4 to form electrical connection with the circuit board 4, further with the contacts 3. The strain relief member 5 is assembled to the circuit board 4 and the cable 9. The pair of side sections 5102 of each connecting portion 510 are respectively soldered to the pair of traces 44 formed on the front and rear surfaces of the circuit board 4, while the flat connecting sections 5101 of the pair of connecting portions 510 respectively locate adjacent to the top and bottom edges 45, 46 of the circuit board 4, even touch the top and bottom edges 45, 46. The front end of the cable 9 is sandwiched between the pair of arms 51 and compressed by the inclined sections 511 and grasped by the strain relief section 52. Thus, the strain relief member 5 realizes the mechanical support to the cable 9. Since the through holes 42 electrically connect with corresponding passageways 41 further with the contacts 3 via inner traces in the circuit board 4, the circuit board 4 realizes the positive and negative power transmission of the cable 9.

Finally, the rear cover 7 and the light pipe 71 are assembled to the assembly achieved above to enclose the all elements except for the flange 10 of the front cover 1. Thus, the toothbrush configuration of the connector assembly 100 is achieved. After the assembly, the front portion of the cable 9 is received in the pipe-shape existing portion 72 of the rear cover 7 and other portion thereof exists from the rear end of the existing portion 72.

Figure 9:
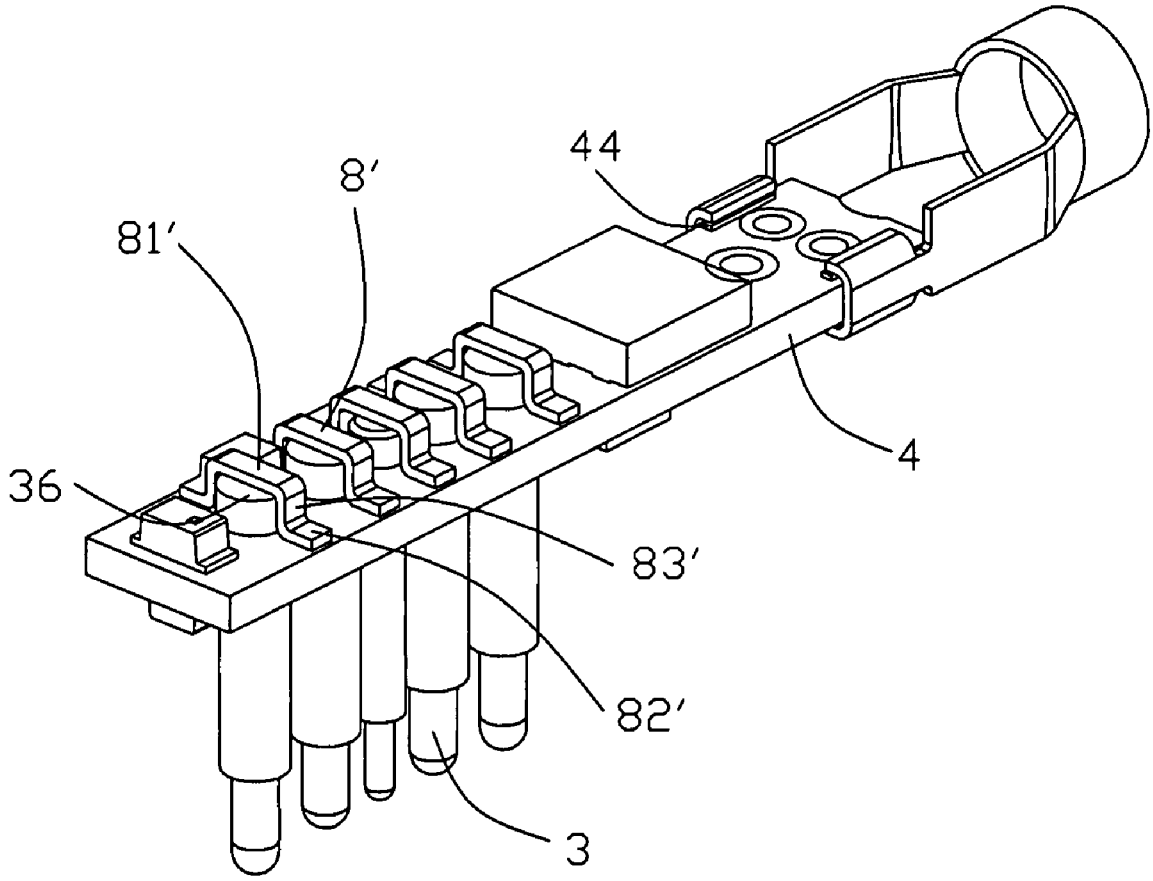
FIG. 9 is a partially assembled view of the connector assembly in accordance with the second embodiment of the present invention.

Now referring to FIG. 9, a second embodiment of the solder tails 8' is shown. The solder tail 8' is of Ω-shape and comprises a pair of second connecting sections 82' soldered with the traces of the circuit board 4, the first connecting section 81' soldered with the end portions 36 of the contacts 3, and a pair of media sections 83' respectively connecting the opposite ends of the second connecting section 82' with the pair of first connecting sections 81'.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A connector assembly adapted for electrically connecting with a complementary connector along a mating direction, comprising:

a housing defining a plurality of passageways along the mating direction;

a plurality of conductive contacts interferentially received in said passageways of the housing;

a circuit board electrically connecting with the conductive contacts and comprising opposite front and rear surfaces and opposite top and bottom edges connecting with the front and rear surfaces;

a cable electrically connecting with the circuit board and comprising an inner conductor, a metal braiding layer and an outer jacket enclosing the metal braiding layer; and a metal strain relief member comprising a strain relief section grasping the cable and at least one connecting portion electrically connecting with the circuit board; and wherein the connecting portion of the strain relief member contacts the opposite front and rear surfaces and locates adjacent to one of the opposite top and bottom edges of the circuit board at the same time;

wherein metal the strain relief member comprises a pair of connecting portions each contacting the opposite front and rear surfaces and adjacent to one of the top and bottom edges of the circuit board;

wherein the inner conductor and the metal braiding layer of the cable are respectively served as positive and negative poles and respectively electrically connecting with the circuit board for power transmission;

wherein the circuit board defines through holes arranged in triangular shape, and wherein the inner conductor and the metal braiding layer of the cable are respectively soldered within the through holes.

2. The connector assembly as claimed in claim 1, wherein the connecting portion of the strain relief member is of U-shape and comprises a pair of side sections and a connecting section connecting the pair of side sections, and wherein the side sections contact the opposite front and rear surfaces of the circuit board and the connecting section locates adjacent to one of the opposite top and bottom edges of the circuit board.

3. The connector assembly as claimed in claim 1, wherein the strain relief member only mechanically connects to the cable and the circuit board.

4. The connector assembly as claimed in claim 1, wherein the circuit board is located in a plane perpendicular to said mating direction.

5. The connector assembly as claimed in claim 1, wherein the strain relief member comprises a pair of connecting portions and a pair of arms connecting the pair of connecting portions with the strain relief section, and wherein the pair of arms extend along directions parallel to the top and bottom edges and locate in parallel planes parallel to the top and bottom edges of the circuit board.

6. The connector assembly as claimed in claim 1, wherein the circuit board comprises a left area and a right area, and wherein the contacts electrically connect with the circuit board at the left area, and the cable and the strain relief member electrically connect with the circuit board at the right area.

7. The connector assembly as claimed in claim 1, further comprising a plurality of solder tails connecting the contacts with the circuit board at a rear surface of the circuit board.

8. The connector assembly as claimed in claim 1, wherein the circuit board forms a pair of pads respectively arranged on front and rear surfaces and located adjacent to at least one of the top and bottom edges, and wherein the connecting portion of the strain relief member comprises a pair of side sections soldered with said pair of pads and a connecting section connecting with the pair of side sections and locating adjacent to at least one of the top and bottom edges.

9. The connector assembly as claimed in claim 1, wherein each contact is of POGO type.

10. The connector assembly as claimed in claim 1, wherein the circuit board forms an LED thereon, and the connector assembly further comprises a rear cover enclosing the housing, the contacts, the circuit board, and wherein the rear cover defines a window area to spread the light emitted from the LED.

11. The connector assembly as claimed in claim 10, further comprising an inner mold partially enclosing the housing, the contacts and the circuit board, and wherein the inner mold is made from transparent or semitransparent material to spread the light emitted from the LED outwards.

12. A connector assembly adapted for mating with a complementary connector along a mating direction, comprising:

an insulative housing;

a circuit board located in a plane perpendicular to said mating direction and comprising a front surface facing to the rear side of the housing, an opposite rear surface, a top edge and a bottom edge opposite to the top edge, the top and bottom edges connecting with the front and rear surfaces, the circuit board defining a left area and a right area;

a plurality of contacts disposed in the housing and electrically connecting with the circuit board at the left area of the circuit board;

a cable electrically connecting with the circuit board at the right area and comprising an inner conductor, a metal braiding layer and an outer jacket; and a metal strain relief member comprising a strain relief section electrically grasping the cable and a connecting portion electrically soldered with the circuit board at the right area of the circuit board; and wherein the connecting portion contacts the front surface, the rear surface and locates adjacent to at least one of the top and bottom edges of the circuit board;

wherein the metal strain relief member comprises a pair of connecting portions each contacting the opposite front and rear surfaces and adjacent to one of the top and bottom edges of the circuit board;

wherein the inner conductor and the metal braiding layer of the cable are respectively served as positive and negative poles and respectively electrically connecting with the circuit board for power transmission;

wherein the circuit board defines through holes arranged in triangular shape, and wherein the inner conductor and the metal braiding layer of the cable are respectively soldered within the through holes.

13. The connector assembly as claimed in claim 12, wherein the strain relief member comprises a pair of connecting portions, one connecting portion contacts the front and rear surfaces and locates adjacent to the top edge of the circuit board, the other connecting portion contacts the front and rear surfaces and locates adjacent to the bottom edge of the circuit board.

14. The connector assembly as claimed in claim 12, wherein the connector assembly is of toothbrush configuration.

15. An electrical connector assembly comprising:

an insulative housing having therein a plurality of contacts essentially commonly extending in a direction;

a plurality of solder tails electrically connecting the corresponding contacts on a printed circuit board, the solder tail being perpendicular to said direction;

a cable extending from one longitudinal end of the printed circuit board; and a metal strain relief having a circumferential section grasping a circumference of the cable, and a pair of opposite arms cooperating with said circumferential section straddling said longitudinal end under a condition that the pair of arms each grasping two opposite side edges of the printed circuit board;

wherein said printed circuit board have two grounding pads beside the two opposite side edges, and the cable has an inner conductor and a pair of braiding strips respectively tightly sandwiched between the corresponding arms and the printed circuit board mechanically and electrically engaged with the corresponding grounding pads;

wherein the circuit board defines through holes arranged in triangular shape, and wherein the inner conductor and the braiding strips of the cable are respectively soldered within the through holes.

* * * * *